US006781524B1

(12) United States Patent
Clark et al.

(10) Patent No.: US 6,781,524 B1
(45) Date of Patent: Aug. 24, 2004

(54) PASSIVE POSITION-SENSING AND COMMUNICATIONS FOR VEHICLES ON A PATHWAY

(75) Inventors: Tracy M. Clark, Bedford, MA (US); Brian M. Perreault, Stow, MA (US)

(73) Assignee: MagneMotion, Inc., Acton, MA (US)

( * ) Notice: Subject to any disclaimer, the term of this patent is extended or adjusted under 35 U.S.C. 154(b) by 0 days.

(21) Appl. No.: 09/528,265

(22) Filed: Mar. 17, 2000

(51) Int. Cl.[7] ..... G08G 1/123

(52) U.S. Cl. ..... 340/933; 340/905; 340/928; 340/935; 340/941; 340/988; 340/989; 180/168; 246/122 R; 246/194

(58) Field of Search ..... 340/933, 941, 340/988, 435, 438, 989, 905, 935, 928, 825.36, 825.49; 180/168, 167, 169; 701/24, 23; 702/150, 94, 95; 246/122 R, 123, 124, 122 A, 194

(56) References Cited

U.S. PATENT DOCUMENTS 2,772,640 A 12/1956 Auer, Jr. et al. ..... 105/199.4

(List continued on next page.)

FOREIGN PATENT DOCUMENTS

| | | |
|---|---|---|
| DE | 235786 | 5/1986 |
| DE | 19535856 | 3/1997 |
| EP | 0229669 | 7/1987 |
| EP | 0482424 | 1/1996 |
| JP | 8129336 | 5/1996 |
| SU | 1140212 | 2/1985 |
| WO | 9521405 | 8/1995 |

OTHER PUBLICATIONS

Eghtesadi, Manochehr. "Inductive Power Transfer to an Electric Vehicle–Analytical Model," 40th IEEE Vehicular Technology Conference (May 6–9, 1990) Orlando, FL.

*Primary Examiner*—Davetta W. Goins
(74) *Attorney, Agent, or Firm*—David J. Powsner; Nutter, McClennen & Fish

(57) ABSTRACT

A pathway-based method, apparatus and system for tracking, sensing and communicating with an object, such as a carriage or vehicle moving on a pathway. The system includes a transmitter winding along the pathway that is energized by a transmitter and one or more sensing windings in which a signal is induced. The vehicle contains a transducer that creates a position-indicating coupling of the transmitted signal into the sensing windings. The transducer may be a passive ferromagnetic or conductive body that locally alters coupling between the windings, or a tuned coil carried on the vehicle that couples energy received from the transmitter into a sensing winding. Absolute position may be established at regular intervals using a discrete position sensor, such as a Hall Effect magnetic field sensor, and, the signal derived from the sensing windings can be monitored, by counting cycles or determining phase, to determine a precise vehicle position. With one sensing winding it is possible to determine distance to about ⅛ of a wavelength and by using two or more phased sensing windings a wayside controller determines the position within a wavelength to a smaller fraction of a wavelength. The position sensing can be accomplished without any source of power on the vehicle, and may extract power from the transducer or position sensing system to drive an electronic communication unit on the vehicle. Modulation of the position sense signal can be used to provide two-way communication between the vehicle and the wayside controller. A typical application is to transmit a vehicle identification number to a controller, or for the controller to activate a mechanism on the vehicle.

51 Claims, 7 Drawing Sheets

U.S. PATENT DOCUMENTS 3,029,893 A 4/1962 Mountjoy ..... 180/168
3,440,600 A 4/1969 Frech et al. ..... 340/988
3,532,934 A 10/1970 Ballman ..... 361/37
3,609,676 A 9/1971 Jauquet et al. ..... 246/187 B
3,617,890 A 11/1971 Kurauchi et al. ..... 455/41
3,628,462 A 12/1971 Holt ..... 104/105
3,636,508 A 1/1972 Ogilvy et al. ..... 246/8
3,679,874 A 7/1972 Fickenscher ..... 365/49
3,768,417 A 10/1973 Thornton et al. ..... 104/282
3,786,411 A 1/1974 Kurauchi et al. ..... 340/988
3,858,521 A 1/1975 Atherton ..... 104/285
3,906,436 A 9/1975 Kurachi et al. ..... 340/989
3,927,735 A 12/1975 Miericke et al. ..... 104/285
3,979,091 A 9/1976 Gagnon et al. ..... 246/8
4,023,753 A 5/1977 Dobler ..... 246/5
4,061,089 A 12/1977 Sawyer ..... 280/51
4,065,706 A 12/1977 Gosling et al. ..... 104/23.2
4,132,175 A 1/1979 Miller et al. ..... 318/254
4,292,465 A 9/1981 Wilson et al. ..... 178/3
4,361,202 A 11/1982 Minovitch ..... 180/168
4,401,181 A * 8/1983 Schwarz ..... 180/168
4,441,604 A 4/1984 Schlig et al. ..... 198/598
4,472,706 A * 9/1984 Hodge et al. ..... 340/941
4,522,128 A 6/1985 Anderson ..... 104/130.07
4,595,877 A * 6/1986 Dulk ..... 324/239
4,665,829 A 5/1987 Anderson ..... 104/124
4,665,830 A 5/1987 Anderson et al. ..... 104/124
4,671,185 A 6/1987 Anderson et al. ..... 104/130.07
4,726,299 A 2/1988 Anderson ..... 104/88.02
4,776,464 A 10/1988 Miller et al. ..... 209/3.3
4,782,342 A * 11/1988 Walton ..... 340/941
4,794,865 A 1/1989 Lindberg ..... 104/246
4,914,539 A 4/1990 Turner et al. ..... 361/18
5,021,778 A * 6/1991 Walton ..... 340/825.54
5,108,052 A 4/1992 Malewicki et al. ..... 246/5
5,242,136 A 9/1993 Cribbens et al. ..... 246/34
5,251,563 A 10/1993 Staehs et al. ..... 104/168
5,263,670 A 11/1993 Colbaugh et al. ..... 246/63
5,267,514 A 12/1993 Staehs et al. ..... 104/246
5,277,124 A 1/1994 DiFonso et al. ..... 104/130.07
5,277,125 A 1/1994 DiFonso et al. ..... 104/292
5,293,308 A 3/1994 Boys et al. ..... 363/37
5,325,974 A 7/1994 Staehs ..... 211/60.1
5,347,456 A * 9/1994 Zhang et al. ..... 364/424.02
5,409,095 A 4/1995 Hoshi et al. ..... 198/370.13
5,435,429 A 7/1995 Van Den Goor ..... 198/890.1
5,573,090 A 11/1996 Ross ..... 191/10
5,590,604 A 1/1997 Lund ..... 104/88.04
5,590,995 A 1/1997 Berkers et al. ..... 414/357
5,592,158 A 1/1997 Riffaud ..... 340/941
5,595,121 A 1/1997 Elliott et al. ..... 104/53
5,669,470 A * 9/1997 Ross ..... 191/10
5,708,427 A * 1/1998 Bush ..... 340/941
5,720,454 A 2/1998 Bachetti et al. ..... 246/34 R
5,757,288 A * 5/1998 Dixon et al. ..... 340/941
5,900,728 A * 5/1999 Moser et al. ..... 324/244
5,906,647 A * 5/1999 Zyburt et al. ..... 701/24
5,927,657 A 7/1999 Takasan et al. ..... 246/194
5,952,743 A 9/1999 Sidey ..... 310/12
6,005,511 A 12/1999 Young et al. ..... 342/70
6,008,552 A 12/1999 Yagoto et al. ..... 310/12
6,011,508 A * 1/2000 Perreault et al. ..... 342/350
6,032,110 A * 2/2000 Ishihara et al. ..... 702/150
6,034,499 A 3/2000 Tranovich ..... 342/350
6,064,301 A * 5/2000 Takahashi et al. ..... 340/435
6,100,821 A * 8/2000 Tanji et al. ..... 340/988
6,137,424 A 10/2000 Cohen et al. ..... 340/933
6,225,919 B1 5/2001 Lumbis et al. ..... 340/933
6,317,338 B1 * 11/2001 Boys ..... 363/25

OTHER PUBLICATIONS

"Asynchronous Bidirectional Network Interface Enabling Seamless Concurrent Processing in a Distributed Heterogeneous Multiprocessor System," (Inventor: Stevens, Bruce W.).

* cited by examiner

PASSIVE POSITION-SENSING AND COMMUNICATIONS FOR VEHICLES ON A PATHWAY

REFERENCE TO RELATED PATENT

This invention is related to U.S. Pat. No. 6,011,508, issued Jan. 4, 2000, and assigned to the assignee hereof, the teachings of which are incorporated by reference herein in their entirety.

BACKGROUND OF THE INVENTION

The invention pertains to vehicular transport and, more particularly, to methods and apparatus for sensing the position of, and communicating with, vehicles or carriages on a pathway. The invention has application, by way of non-limiting example, in track- or guideway-operated vehicular systems, in warehouse or manufacturing line carriage systems, and in highway vehicular systems. Among the notable features of the invention is the passive nature of the position sensing system, which permits determination of a vehicle's position (e.g., by a wayside station) without requiring a source of power on the vehicle itself.

The prior art proposes a number of methods for determining vehicle position. For example, U.S. Pat. No. 6,005,511, for a highway vehicle guidance system, issued Dec. 21, 1999, suggests using radar signals to interact with stripes in the highway; see also, U.S. Pat. No. 6,008,552, issued Dec. 28, 1999, and U.S. Pat. No. 6,034,499, issued Mar. 7, 2000.

Such prior art systems require a battery, generator or other power source on the vehicle, e.g., to support the on-board generation of signals that directly or indirectly indicate its position and that are transmitted to a wayside station, to another vehicle, or the like, for interpretation. While on-board power is available in many cases, it is often not. This is particularly true, by way of non-limiting example, with smaller vehicles such as are used for material handling systems and for thrill rides.

Regardless of whether such vehicles have a convenient source of on-board power, there are typically stringent demands for sensing their positions precisely. In some cases, vehicles operating with headways of one second or less have been proposed. Without accurate, up-to-date position information, safe operation can be jeopardized.

A variety of methods have been used in the prior art to enable communication between a vehicle and the wayside. Most of these involve the use of wireless radio communications. One disadvantage of such schemes is signal degradation from intervening structures such as buildings and tunnel walls. Another disadvantage is their requirement for on-board energy, which may be unavailable in unpowered vehicles.

A common use of vehicle-to-wayside communications is the transmission of vehicle identifications, typically, vehicle ID numbers. The prior art has proposed some options for this which do not require on-board electronics or on-board power. These typically call for labeling the vehicles with bar codes, or the like, and detecting those codes with readers disposed at wayside. Unfortunately, such solutions are expensive and subject to improper operation, e.g., due to accumulation of dirt or other environmental factors. While less expensive solutions have been proposed, they still often fall victim to environmental factors.

In view of the foregoing, an object of the invention is to provide improved methods and apparatus for pathway-based position sensing and communication.

Another object of the invention is to provide such methods and apparatus as can be applied to sensing the positions of, and communicating with, vehicles operated on or in conjunction with a pathway.

Yet another object of the invention is to provide such methods and apparatus as can be applied to all types of vehicles, regardless of whether they travel over rail, road or other mediums.

Yet still another object of the invention is to provide such methods and apparatus as permit vehicle detection and communication, e.g., regardless of whether the vehicle is underground or otherwise obscured from contact with a ground station antenna or satellite.

SUMMARY OF THE INVENTION

The foregoing are among the objects attained by the invention, aspects of which provide a position sensing system that generates a vehicle position signal in one or more sensing windings, e.g., for detection by a wayside controller. The system is advantageous in that it requires no power source on board the vehicle, i.e., the vehicle can be "passive."

According to one aspect, a system according to the invention includes a flux or field source and one or more sensing windings disposed along a pathway. A transducer (or other coupling element) is configured to couple energy from the source to the sensing winding(s) to induce therein a signal that varies with the position of the coupling element along the pathway.

The pathway can be a highway, railway, guideway of a linear motor system, or any other vehicle or carriage way. The flux source may be provided by one or more transmission windings that are disposed along that way. Such transmission windings, which can be actively powered in order to provide local magnetic field flux, are preferably disposed with respect to the sensing windings such that little or no net signal is coupled between them, e.g., except in the proximity of the coupling element.

According to further aspects of the invention, the coupling element is carried on a vehicle, carriage or other object whose position along the pathway is to be determined. The coupling element can be a passive structure, such as a simple body of ferromagnetic material, of conductive material, or of a combination of both. It may also comprise one or more receiver loops that are tuned, e.g., with a capacitor or other element, to resonate at a frequency of a signal generated by the transmission winding or other flux source.

According to related aspects of the invention, the sensing windings have a spatial configuration that localizes or varies their reception characteristics vis-a-vis energy coupled from the transmission winding(s). As a consequence, the form of the position signal generated in a sensing winding varies in dependence upon where the transducer or other coupling element is positioned.

In related aspects, the invention provides systems as described above in which one or more sensing windings are arranged as a series of loops of alternating sense. Movement of the coupling element over the loops induces position signals with envelopes that vary with position and that have periodic nulls or dips.

Still further related aspects of the invention call for use of a transmission winding with loops that are disposed at a period that is a multiple or sub-multiple of the period of the sensing loops. Alternatively, or in addition, the transducer can have a width (or other dimension) in the direction of the pathway that is a multiple or submultiple of the transmission winding loop and/or sensing winding loop periods.

Thus, by way of non-limiting example, the period of the transmitter loops may be twice that of the sensing loops, and so forth. This can be effective to provide an induced position signal envelope with well defined nulls or dips and, otherwise, with a definite envelope form as the transducer moves along the pathway. Preferably, two offset sensing windings are employed to provide phased signals that may be combined for enhanced position resolution.

An advantage of a system according to the aforementioned aspects of the invention is that it can eliminate the need for powered electronics on-board the vehicle, carriage or other object whose position is being determined.

In cases where on-board electronics may be required, power can be derived from the signal in the transmission winding without the need for a permanent storage unit (e.g., battery) or other power source. To this end, further aspects of the invention call for systems as described above in which a tuned receiver loop is utilized as a coupling element to inductively transfer power to the vehicle.

According to related aspects of the invention, circuitry is provided for effecting communications to/from the vehicle on the pathway. For example, a receiver loop as described above can be utilized to receive a command signal sent to a vehicle on the pathway by the wayside controller. Such a loop can also be utilized to send information. By way of example, the coupling effect of the tuned receiver loop can be varied (e.g., by lowering the Q of the tuned circuit) to encode a communication signal "on top of" the position signal in the sensing windings. This aspect of the invention can be utilized by a vehicle in order to send its identification number, or ID, to a wayside controller. The allows one-way or two-way communications without requiring a battery or other power source on the vehicle.

Still further aspects of the invention provide systems as described above in which the transmission and sensing windings are disposed among stator motor windings of a linear motor. Advantageously, the period the transmission and sensing winding loops, and the width of the transducer, can be selected to avoid interference from the stator motor windings and to couple clear signals.

The foregoing and other aspects of the invention are evident in the drawings and in the description that follows.

BRIEF DESCRIPTION OF THE DRAWINGS

A more complete understanding of the invention may be attained by reference to the description below, taken together with illustrative drawings showing details of construction for representative embodiments, in which.

DETAILED DESCRIPTION OF THE ILLUSTRATED EMBODIMENTS

Theory of Operation

Applicant's invention employs a wayside sensing winding or windings, and a passive or not-actively-powered vehicle transducer to couple a signal into the sensing winding for indicating position. The theory of operation will be initially described based upon a transducer which simply acts as a coupling element C (FIG. 2), composed of a ferromagnetic material, and an illustrated implementation employing a transmitter winding Tx, two sensing windings D,Q (FIG. 1), and a ferromagnetic backing F (FIG. 2), in addition to the transducer. The ferromagnetic backing increases the signal strength, but is not essential to operation. Other implementations are possible, and are described in following sections.

Figure 1:
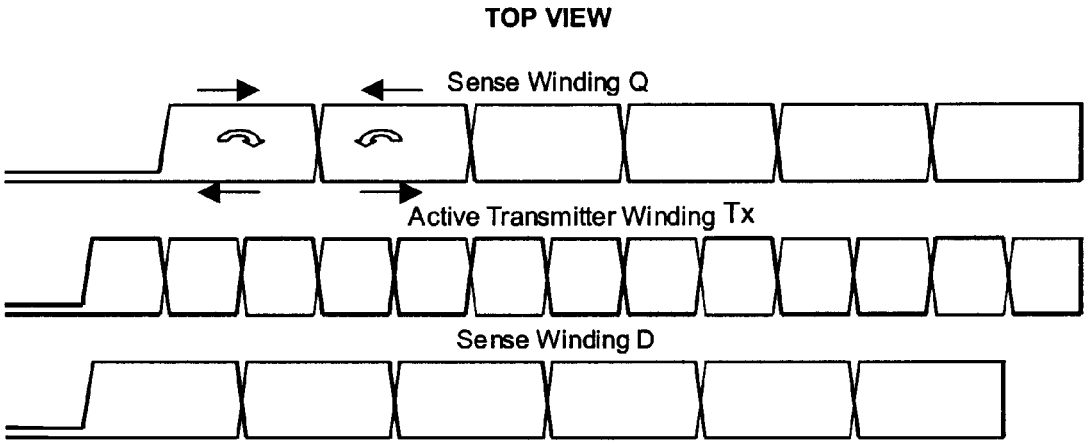
FIG. 1 depicts one winding structure for a passively coupled position-sensing system of the invention.

FIG. 1 shows a top view of a winding architecture composed of three windings. The three windings are situated coincidentally on top of one another, for example, in a thin belt-like band or strip, or positioned in shallow meandering grooves or channels, although the windings are separated in the figure for illustrative purposes to better show the structure of each separate winding. As shown, the windings include a series of loops, and, as shown schematically by the current arrows on the first two loops of winding Q, a signal flowing in the winding follows alternating clockwise and counterclockwise current paths in successive loops. In cases where the position sensing is used with a linear motor, the active transmitter winding is designed with a pole pitch double that of the motor so as to minimize coupling to the motor field. In other cases the winding pitch is chosen according to the resolution desired and the gap between the vehicle structure and the pathway windings. The sensing windings are illustrated with a pole pitch double the pitch of the transmitter winding, or four times the pole pitch of the linear motor, if it exists. Thus, there is very little coupling between the motor field and either the transmitter winding or the sensor windings.

Figure 2:
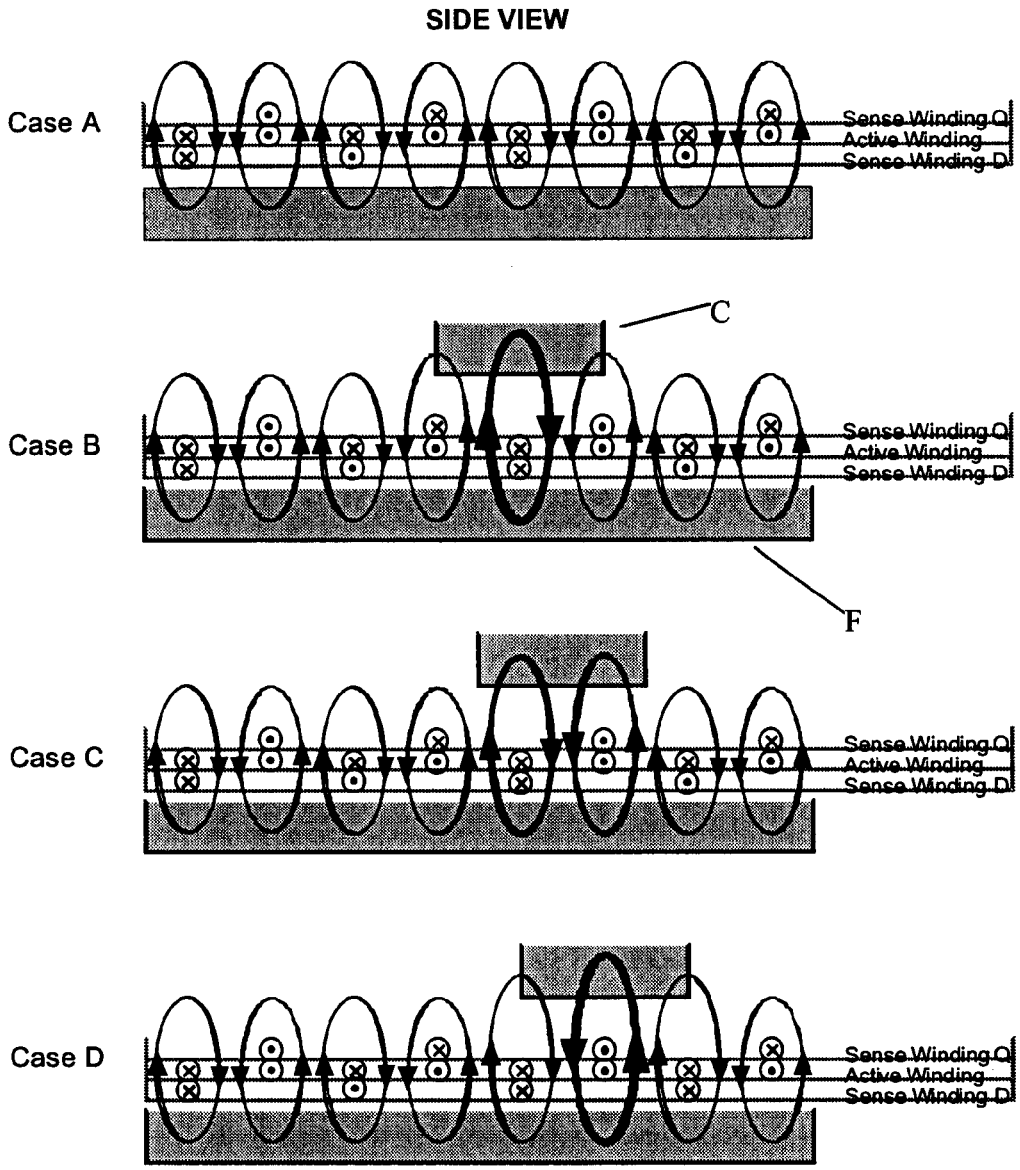
FIG. 2 depicts magnetic field coupling for various transducer positions along the winding structure of FIG. 1.

The active or transmitter winding Tx is driven with a sinusoidal carrier. FIG. 2 shows a longitudinal cross-section in a vertical plane along the middle of the windings in FIG. 1, along with a simplified illustration of the magnetic fields generated by the loops of the active winding. With the transducer C absent, as shown in the first panel of FIG. 2, there is virtually no coupling of the carrier between the transmitter winding and the sensing windings due to the relationship between the pole pitches of the two types of windings. This fact is illustrated as Case A in the Figure.

When the transducer is present, as shown in Case B, the coupling between the active winding and the sensing windings is changed. It is desirable for the length of the transducer to be approximately the length of the sensing winding pole pitch, in order to both reduce noise coupling from the motor as well as achieve the desired coupling function between the transmitter and sensing windings. The transducer provides a low reluctance path for the flux to follow, increasing the magnitude of the fields in the proximity of the block (as well as changing the shape of the fields). As shown, the block lies directly over sensing winding Q and couples no net flux into sensing winding Q, while it lies partly over each of two different loops of opposite orientation (or sense) in sensing winding D. The coupled flux therefore induces additive signals in that winding, coupling a net signal in the region of increased flux into sensing winding D. This corresponds to an electrical position of zero degrees.

Case C illustrates the instance where there is a positive net coupling into both of the sensing windings. This example corresponds to a motor position of 180 degrees and a location of 45 degrees in the positioning system. Case D of FIG. 2 illustrates the instance where there is a positive net coupling into Sensing winding Q, and no net coupling into Sensing winding D. This example corresponds to a motor position of 360 degrees (or 0 degrees) and a location of 90 degrees in the positioning system.

Figure 3:
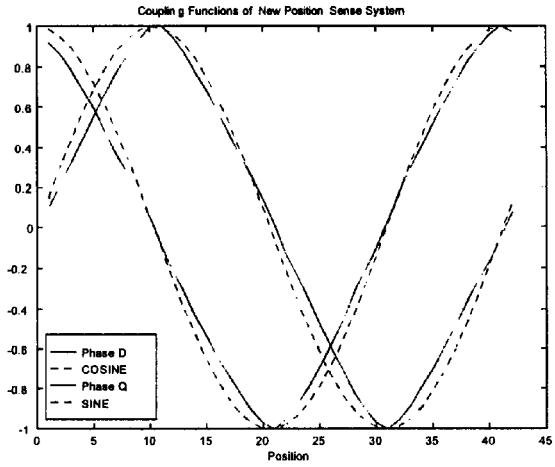
FIG. 3 shows experimentally determined coupling functions for a passively coupled system like that of FIG. 1.

Thus, the net effect of the transducer is to provide a coupling between the transmitter winding and sensing windings, which varies with the position of the transducer. A set of test windings has been placed on a slotted motor in the laboratory, and the theory tested. The windings were connected to the electronics, and successful positioning was achieved. The coupling function for the two phases is shown in FIG. 3. The coupling functions show a spatial variation that is approximately sinusoidal, but slightly more triangular in shape. More sinusoidal coupling functions may be achieved by modifying the shape of the transducer or the winding for a slotless embodiment.

Other Embodiments

The configuration described so far has utilized a ferromagnetic transducer on one side. Alternately, a transducer may straddle the windings, resulting in much the same coupling function between windings. For example, the transducer may comprise a U-shaped element that rides above and below and/or along the transverse sides of the windings.

The position-sensing system of this invention achieves a signal coupling between the transmitter winding and the sensing windings that varies with the position of a vehicle. This coupling variation may also be achieved by utilizing a conductive plate as the transducer, approximately the length of the sensing winding pole pitch. Rather than increasing the field in the proximity of the transducer, the conductive plate bucks out a field in its proximity, changing the coupling between the transmitter winding and the sensing windings. In a linear motor system, the installation of such a plate underneath the propulsion magnet array on the carriage will accomplish a further, secondary purpose of protecting the magnets. The effect of such a conductive plate is not as strong as that of the ferromagnetic transducer, and is thus considered to be a less desirable implementation. However, a combination of the ferromagnetic transducer and conductive bucking plate may prove to be quite useful.

Several other configurations are contemplated. Rather than two sensing windings, the system may be implemented in configurations with a single sensing winding, or three or more sense phases. Also, a configuration with multiple transmit windings (each with a different frequency) and either a single or multiple sensing windings is within the scope of the invention.

Figure 4:
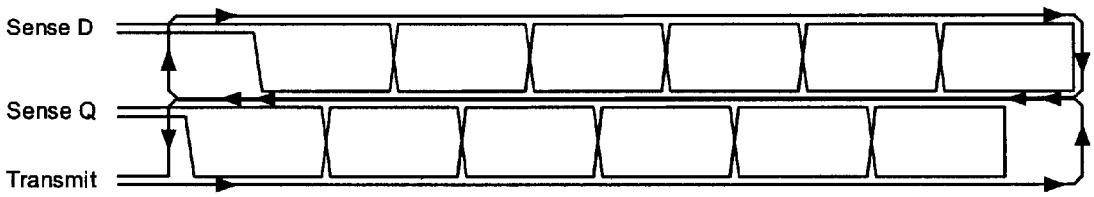
FIG. 4 shows another embodiment of a passively coupled position-sensing winding structure.

FIG. 4 illustrates another winding structure of the invention to implement a passive position signaling system. The active or transmitter winding in this illustration is a very wide figure-eight coil. The sensing windings are each placed inside a respective one of the two loops of the active winding. A suitable transducer for this system would be as wide as the active winding and have a length substantially equal to one pole pitch of the sensing windings. One advantage of such a structure is that a pole pitch half as long as that of the embodiment of FIG. 1 may be used. However, a disadvantage of this structure is that there are larger radiated emissions from the transmitter.

Figure 5:
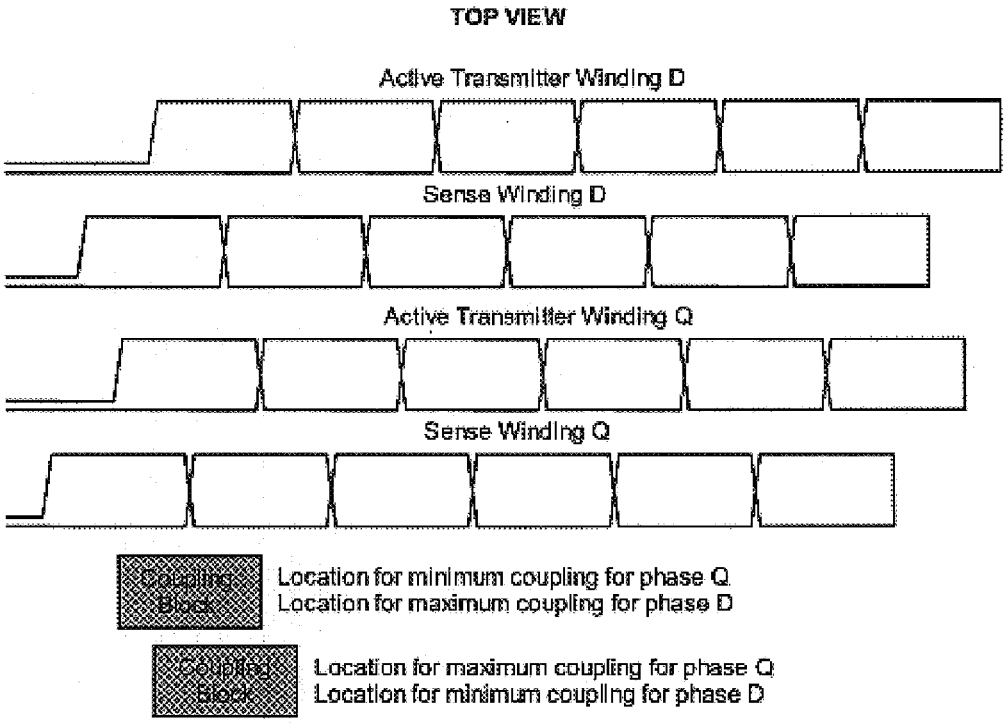
FIG. 5 shows a third embodiment of a passively coupled position-sensing winding structure.

A different winding structure is shown in FIG. 5. In this approach, the winding pole pitch is double the pole pitch of the motor in order to achieve rejection of motor signals. There are two active transmitter windings, each excited with a signal of a different, but related, frequency. The frequencies are chosen such that an interval common to both may be used for integration, while the demodulation or processing of the signal from each coil rejects the frequency induced by the other transmitter winding. Thus, the 'D' transmitter frequency is rejected in the 'Q' receiver, and vice versa. This rejection is necessary since some signal from the 'D' transmitter is coupled into the 'Q' sensing winding. Note that it is also possible to subtract out the 'D' frequency signal from the winding 'Q' signal before demodulation to gain additional rejection.

An Embodiment Using Tuned Circuits

The invention also contemplates a system that operates to effect communication with a passive source of power on the vehicle. Communication may require only a few milliwatts, but it is desirable to not depend upon batteries, solar cells or other potentially unreliable sources. One embodiment of such a system of the present invention transfers power via inductive coupling using a pathway winding structure somewhat similar or related to those described above. However, the passive transducer structures described above are replaced with one, or a sequence of, tuned circuits. These circuits not only provide the position sensitive coupling between transmitter and sensor windings, but they also provide a net source of power for activating low power inductive communication as described further below in connection with FIG. 8.

Figure 6:
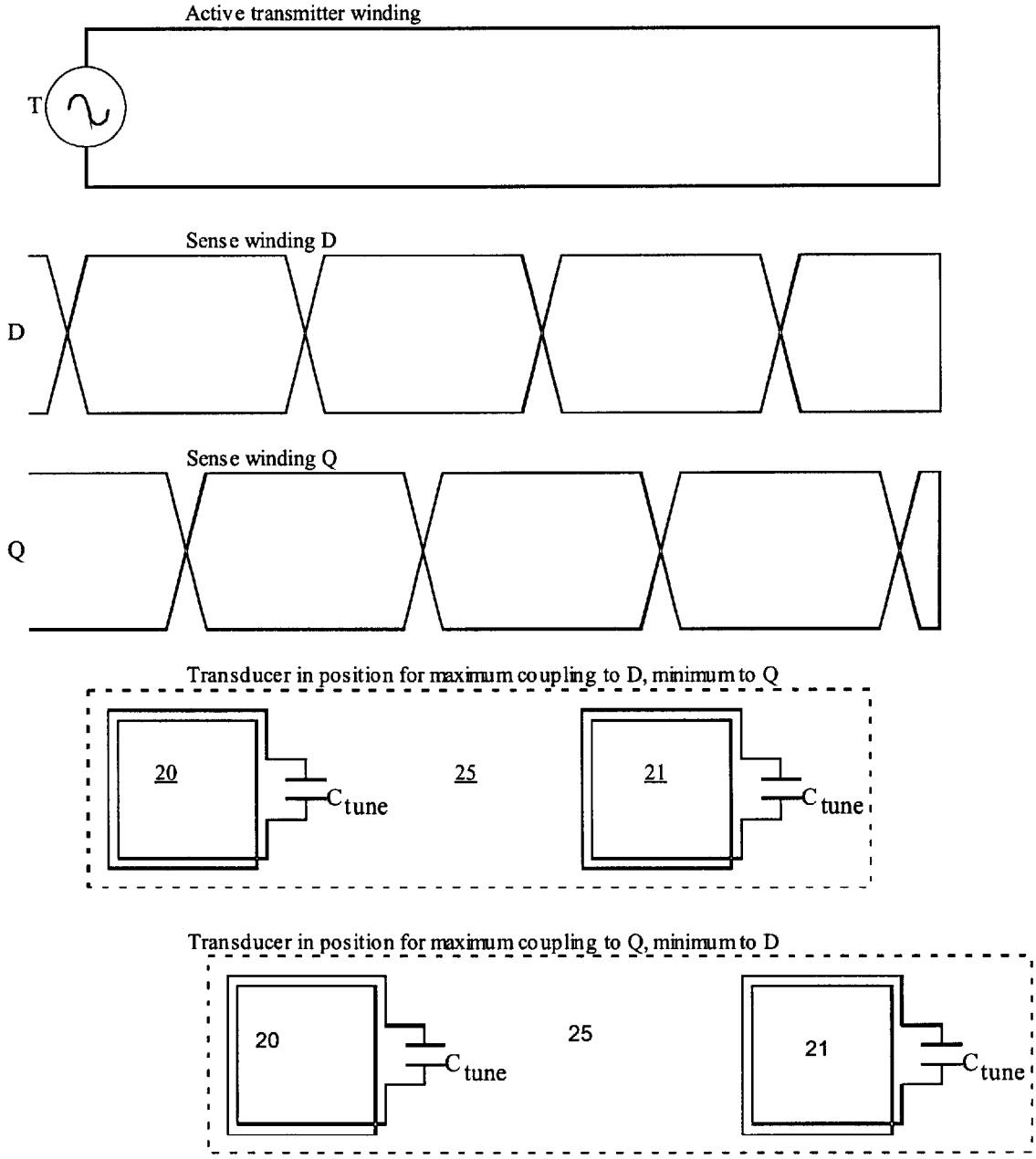
FIG. 6 shows an embodiment in which tuned circuits on the vehicle resonate at the frequency of the transmitted signal and thereby cause distance dependent coupling for position sensing.

FIG. 6 shows one implementation of a tuned loop transducer structure 25 including a plurality of spaced-apart tuned circuits on the vehicle. In practice, transducer assembly 25 may include any number of coils, but only two, coils 20, 21 are shown. Each coil may consist of multiple turns, but for simplicity they are shown as two-turn coils, and each coil is connected in series with a tuning capacitor, $C_{tune}$ that causes resonant behavior at the frequency of the transmitted signal. As in the embodiment of FIG. 1, two sensing windings, spatially offset from one another, with loops of alternating polarity run along the pathway, so that as the coils pass over the sensing windings, position signals are developed in the sensing winding. In some positions power is coupled into the tuned coil circuits 20, 21 and then back out to the sensor winding D but not into winding Q. In other positions there is no net coupling to D but a net signal is coupled into winding Q. Operation is then very similar to the embodiments described above in which a ferromagnetic block is used as the transducer on the vehicle.

Using a Tuned Transducer to Develop Power for On-Board Use

Figure 7:
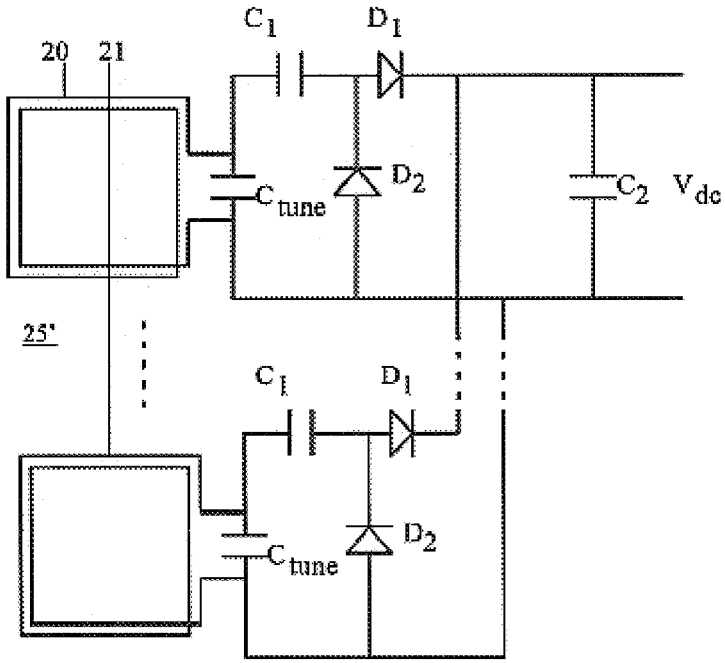
FIG. 7 shows power extraction from the transmitted signal via a tuned circuit transducer to power on-board electronics.

With the tuned circuit position transducer, the invention further contemplates systems extracting some power from the tuned circuit via a rectifier and filter, which may also be incorporated in a single transducer body 25' carrying the coil circuits. FIG. 7 shows an embodiment 25' of this aspect of the invention, with two tuned circuits consisting of coils 20, 21 (others may also be present) and capacitors $C_{tune}$. Each tuned circuit is connected to a conventional voltage-doubling rectifier arrangement D1, D2, and the outputs of the rectifier arrangements are connected in parallel. Other forms of rectifier circuit may be used, but the use of a voltage multiplier type rectifier or a charge pump circuit produces a substantial DC voltage to drive on-board electronics without requiring an excessive number of turns in the tuned circuit coils. The extraction of power in this manner will lower the Q of the tuned circuit, but not enough to adversely affect the operation of the position sensing system.

Communication of Vehicle Identification Numbers

Figure 8:
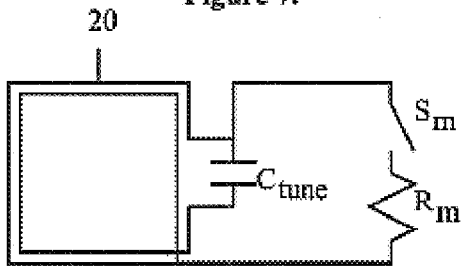
FIG. 8 illustrates vehicle modulation of the Q of the tuned circuit to modulate the sensed signal, thus, allowing transmission of data from the vehicle to a wayside controller.

The invention contemplates another method of communication using on-board power that can be delivered via the tuned circuit transducers. In this case a simple electronic circuit can be used to repeatedly send a binary coded number. FIG. 8 shows one implementation of this aspect of the invention. A conventional finite state machine, driven by an oscillator, alternately opens and closes a switch $S_m$ in a manner that signifies the ID number. The switch and finite state machine may be readily implemented, for example with a small gate array and oscillator. The switch $S_m$ connects a resistor R in parallel with the tuned circuit or, in alternative embodiments, a portion of the tuned circuit. This resistor R lowers the Q of the tuned circuit, reducing the coupling to the pathway sensing windings. By opening and closing the switch in a prescribed pattern a digital signal is carried as a modulation on the signal received in the sensing winding. Only about 5% percent modulation is required to generate a communication signal that can be dependably detected in the sensing winding by a wayside communication controller and converted to a vehicle ID.

Alternatively or in addition to the foregoing, commands and/or other information signals, e.g., sent by a wayside station over the transmission windings, may be inductively received by a coil on the vehicle. Such a signal may be demodulated, amplified, processed or otherwise applied in the conventional manner, e.g., using circuitry (not shown) that is, however, powered by the transducer circuitry of FIG. 7.

Integration Of The Position Sensing System With A Linear Motor

Figure 9:
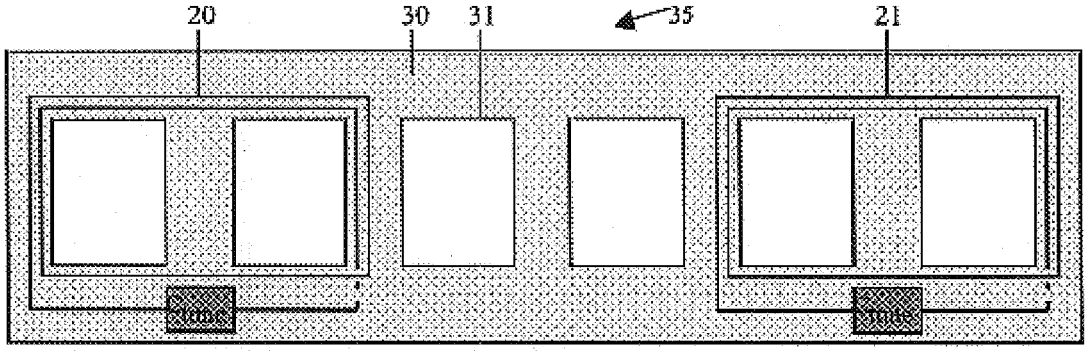
FIG. 9 depicts a printed circuit board implementation of the tuned circuit of FIG. 6, especially useful for linear synchronous motor applications, wherein the tuned circuits are constructed using printed circuit board technology with holes placed so that the board fits over an array of permanent magnets used as field excitation for a linear synchronous motor on the vehicle.

An important application for this invention is for position sensing of a vehicle that is powered by a linear motor. It has been pointed out above that suitable loop dimension or other measures can minimize cross coupling from the motor circuits to the position sensing circuits. In embodiments for linear motor systems, it is also helpful to be able to physically integrate the transducer into the vehicle magnet structure and to integrate the transmitter and sensor windings into the stator motor windings. FIG. 9 shows one transducer structure 35 that achieves the first objective. Transducer coils 20 and 21 are constructed on printed circuit board 30 that also holds the tuning capacitors $C_{tune}$. Holes 31 are punched in the circuit board 30 and holes are punched in the board so that it can be placed over the permanent magnet poles which reside on the vehicle for its linear motor drive system. If communication electronics are to be used, they can also be constructed on the same printed circuit board. The transmitter and sensing windings are then wound in slots in the motor primary and on top of the propulsion winding, so that their position is precisely laid out with respect to the propulsion winding. The net effect is to create an inexpensive position sensing system that is precisely aligned to the linear motor.

The example shown in FIG. 9 is for a linear synchronous motor, but the invention contemplates a similar structure to work with a linear induction motor.

Figure 10:
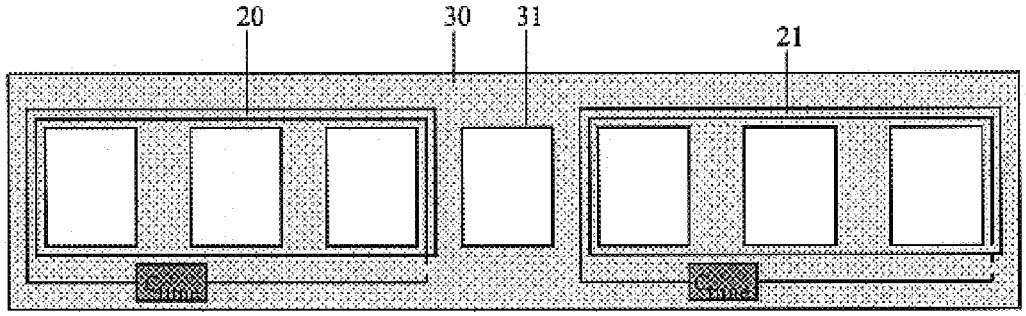
FIG. 10 depicts a printed circuit board implementation for symmetric mounting with an array of permanent magnets used as for field excitation for a linear synchronous motor on the vehicle.

FIG. 10 shows a modification of the embodiment of FIG. 9 for a vehicle that is symmetric. This is especially useful for a vehicle such as a robotic work piece carrier that may be reversed end-to-end to travel in either direction along a pathway. In this symmetric embodiment, the two resonant coils 20, 21 are each of a size to cover three out of four successive poles of the motor field array (or covering one-and-one-half out of two successive sense loops, since the pole pitch ratio of the sensor to the motor is 2:1). This method is not as efficient as the one shown in FIG. 8, but it has the virtue that the position signal registration remains the same when the symmetric vehicle is turned end for end. This may be desirable in some applications such as for pathway mounted vehicles that are bi-directional.

The foregoing description and drawings describe a number of system configurations wherein windings, transmitters, transducers, sensors and techniques for use thereof permit the pathway sensing of, tracking of, and communication with objects, such as carriages and vehicles. It will be appreciated that these may be employed in a range of applications, including automated material handling, thrill ride vehicles, and vehicles used for transporting people and freight.

It will also be appreciated that the illustrated embodiments are discussed herein by way of example and that, the invention being thus disclosed, other embodiments adapting systems of the prior art or modifying the disclosed embodiments will be readily understood or adapted by those skilled in the art, and all such adaptations and modifications fall within the scope of the invention.

Thus, for example, windings, transmitters, transducers and sensors may be constructed from materials and in configurations other than those shown above. Moreover, those components may be used (and their signals interpreted) using logic, analog circuits, processing or techniques other than the specific ones shown in the drawings and recited in the accompanying text. Still further, as used throughout this application the term transducer refers to transducers, tuned circuits, and other coupling elements (preferably passive) that serve to transfer energy from the flux (or field) source into the sensing windings in the manner described above.

By way of a still further non-limiting example, whereas the position-sensing and communications signals are described above as periodic, or induced in spatially periodic windings, those skilled in the art will appreciate that they may be quasi-periodic, as well, or even have progressive or simply pre-defined lengths.

Yet still further, the systems described herein can be utilized in connection with linear motor and other transport systems of the types described in applicant's aforementioned incorporated-by-reference United States Patent.

We claim:

1. A system for determining position along a pathway, the system comprising a magnetic flux source disposed along the pathway, at least a first sensing winding comprising a plurality of inductive loops of alternating sense disposed along the pathway in stationary proximity to the magnetic flux source, where loops of alternating sense alternate in sense with respect to one another, and a moveable coupling element configured to couple energy from the flux source to the first sensing winding to induce therein a position signal that varies with a position of the coupling element along the pathway.

2. A system according to claim 1, wherein the flux source comprises a transmitter winding that includes one or more current loops of alternating sense disposed along the pathway, each current loop generating magnetic flux.

3. A system according to claim 2, wherein the transmitter winding forms at least a part of a stator motor winding of a linear motor.

4. A system according to claim 2, wherein the transmitter winding is disposed in proximity to a stator motor winding of a linear motor.

5. A system according to claim 4, wherein at least one of the transmitter winding and the first sensing winding has a period that is a multiple of a period of the stator motor winding.

6. The system of claim 1, wherein the flux source defines the pathway.

7. The system of claim 1, wherein the coupling element is arranged for movement with an object, such that the position signal varies with a position of the object along the pathway.

8. The system of claim 1, comprising a second sensing winding, the second sensing winding comprising a plurality of inductive loops of alternating sense disposed along the pathway, the coupling element being configured to couple energy from the flux source to the second sensing winding to induce therein a position signal that varies with a position of the coupling element along the pathway.

9. The system of claim 8, wherein the inductive loops of the first sensing winding are offset from the inductive loops of the second sensing winding with respect to a direction of the pathway.

10. The system of claim 8, wherein the inductive loops of the first sensing winding are periodically spaced along the pathway, the inductive loops of the second sensing winding are periodically spaced along the pathway, and the inductive loops of the first sensing winding are offset in phase from the inductive loops of the second sensing winding with respect to a direction of motion along the pathway.

11. The system of claim 10, wherein the offset is substantially equal to +/−180°/n, for even values of n, and is substantially equal to +/−360°/n, for odd values of n, where n is a number of sensing windings.

12. The system of claim 8, wherein the coupling element is arranged for movement with an object, such that a position of the object along the pathway is determinable from the position signals induced in the first and second sensing windings.

13. The system of claim 12, wherein a position of the object along the pathway is determinable from a ratio of the position signals induced in the first and second sensing windings.

14. A pathway system for a carriage, the system comprising a magnetic flux source disposed along the pathway, the flux source comprising one or more current loops that generate magnetic flux, at least a first sensing winding, the first sensing winding comprising a plurality of inductive loops of alternating sense disposed along the pathway in stationary proximity to the magnetic flux source, where loops of alternating sense alternate in sense with respect to one another, and a transducer assembly coupled to the carriage, the transducer assembly comprising a resonant current loop positioned to couple energy from the flux source to the first sensing winding to induce therein a position signal that varies with a position of the coupling element along the pathway.

15. The pathway system of claim 14, wherein the resonant current loop generates a power signal for use with respect to the carriage.

16. The pathway system of claim 15, wherein a tuning of the resonant current loop is varied in order to impose a further signal on the position-indicating signals induced in the first sensing winding and any other sensing windings that may exist.

17. The pathway system according to claim 15, wherein the further signal identifies the carriage.

18. A system for determining a position of a carriage along a pathway, the system comprising a magnetic flux source disposed along the pathway, the flux source comprising one or more current loops that generate magnetic flux, at least a first sensing winding, the first sensing winding comprising a plurality of inductive loops of alternating sense disposed along the pathway in stationary proximity to the magnetic flux source, and a coupling element arranged for movement with the carriage, the coupling element configured to couple energy from the flux source to the first sensing winding to induce therein a position signal that varies with a position of the coupling element along the pathway.

19. The system of claim 18, wherein the coupling element comprises one or more of a conductive material, paramagnetic material, a ferromagnetic material, and a resonant loop.

20. The system of claim 19, wherein the coupling element has a dimension relative to a direction of the pathway less than twice a dimension of the inductive loops relative to that direction.

21. The system of claim 20, wherein the coupling element has a dimension relative to a direction of the pathway substantially equal to a dimension of the inductive loops relative to that direction.

22. The system of claim 18, comprising a second sensing winding, the second sensing winding comprising a plurality of inductive loops of alternating sense disposed along the pathway, the coupling element being configured to couple energy from the flux source to the second sensing winding to induce therein a position signal that varies with a position of the coupling element along the pathway.

23. The system of claim 22, wherein the inductive loops of the first sensing winding are periodically spaced along the pathway, the inductive loops of the second sensing winding are periodically spaced along the pathway, and the inductive loops of the first sensing winding are offset in phase from the inductive loops of the second sensing winding with respect to a direction of motion along the pathway, the offset being substantially equal to +/−180°/n, for even values of n, and is substantially equal to +/−360°/n, for odd values of n, where n is a number of sensing windings.

24. The system of claim 18, wherein the flux source a transmitter winding, the transmitter winding comprising a plurality of current loops of alternating sense disposed along the pathway, each current loop generating magnetic flux.

25. A system for determining position along a pathway, the system comprising a transmitter winding disposed along the pathway and defining a magnetic field along the pathway, a first sensing winding arranged along the pathway in stationary proximity to the transmitter winding, the sensing wining, the sensing winding having a plurality of inductive loops of alternating sense, the first sensing winding being positioned such that movement of a coupling element along the pathway couples energy from the transmitter winding to the first sensing winding to induce therein a position signal that varies with a position of the coupling element along the pathway.

26. The system of claim 25, wherein the transmitter winding defines a plurality of flux regions of alternating polarity disposed along the pathway.

27. The system of claim 26, wherein the inductive loops of the first sensing winding are periodically spaced along the pathway, the flux regions are periodically spaced along the pathway, and the inductive loops of the first sensing winding are aligned with respect to the flux regions of the pathway.

28. The system of claim 27, wherein a period of the inductive loops is an integer multiple of a period of the flux regions.

29. The system of claim 27, wherein a period of the flux regions is a multiple of a period of the inductive loops.

30. A system for determining position of a carriage along a pathway, the system comprising a transmitter winding comprising a plurality of current loops of alternating sense disposed along the pathway, each current loop generating magnetic flux, a first sensing winding arranged along the pathway in stationary proximity to the transmitter winding, the first sensing winding having a plurality of inductive loops of alternating sense, a second sensing winding, the second sensing winding comprising a plurality of inductive loops of alternating sense disposed along the pathway, a coupling element that is arranged for movement with the carriage, the first and second sensing windings being positioned in relation to the flux source and the pathway such that movement of the coupling element along the pathway couples energy between the flux source and the first and second sensing windings to induce therein position signals that vary with a position of the carriage along the pathway.

31. The system of claim 30, wherein the inductive loops of the first and second sensing windings are periodically spaced along the pathway, yet, are offset in phase from one another with respect to a direction of motion along the pathway, the current loops of the transmitter winding are periodically spaced along the pathway, and the inductive loops of the first and second sensing winding are aligned with respect to the current loops of the transmitter winding along a direction of motion along the pathway.

32. The system of claim 30, wherein a period of the inductive loops is an integer multiple of a period of the current loops.

33. The system of claim 31, wherein a period of the current loops is an integer multiple of a period of the inductive loops.

34. The system of claim 30, wherein a position of the carriage along the pathway is determinable from a ratio of the position signals induced in the first and second sensing windings.

35. A method for determining position along a pathway, wherein the method comprises the steps of providing a magnetic flux source disposed along the pathway, providing a sensing winding disposed along the pathway in stationary proximity to the magnetic flux source, and arranged in a plurality of inductive loops of alternating sense, wherein the step of providing the sensing winding includes positioning the winding such that movement of a coupling element along the pathway couples energy between the flux source and the sensing winding to produce a position signal in the sensing winding.

36. A method for determining position of a carriage or the like moving along a pathway in a system having a current winding fixedly extending along the pathway that constitutes a linear motor for operatively driving the carriage along the pathway, such method comprising the steps of providing at least one sensing winding arranged stationary and proximate to the pathway and the current winding, the sensing winding including multiple loops with each loop having a spatial period and being disposed along the pathway with alternating sense operating the current winding as a transmitter to transmit electromagnetic energy, and mounting a transducer on the carriage to passively receive the energy in a resonant current loop, the transducer being positioned to induce a signal in the sensing winding as the transducer moves along the pathway such that the induced signal in the winding indicates transducer position.

37. A method for signaling position of a carriage or the like moving along a pathway in a system having a current winding extending along the pathway that constitutes a linear motor for operatively driving the carriage along the pathway, such method comprising the steps of providing a plurality of sensing windings in stationary proximity to the pathway, each sensing winding having a period and being offset along the pathway operating the current winding to generate magnetic flux, and passively receiving flux on the carriage in a resonant current loop, the loop being positioned to induce position-indicating signals in the sensing windings as the carriage carries the transducer along the pathway.

38. A pathway system for determining position of a carriage, vehicle or the like (collectively, "carriage") moving along a pathway, the system comprising a coil assembly configured for extending along and being securable against movement with respect to pathway, wherein the coil assembly includes a transmitter winding, a first sensing winding and a second sensing winding, the first and second sensing windings being spatially periodic and out of phase with respect to each other and in stationary proximity with the transmitter winding, the transmitter winding being deposed for electromagnectic coupling of flux generated thereby to the first and to the second sensing windings, such that motion of a coupling element carried by a carriage on the pathway varies inductive coupling between the transmitter winding and the first and second sensing windings so as to passively generate therein signals that vary with a position of the carriage along the pathway.

39. The pathway based system of claim 38, wherein the first and second sensing windings have the same spatial period, yet, are offset in phase with respect to a direction of motion of the carriage along the pathway.

40. The system of claim 39, wherein the transmitter winding has a period that is a multiple of periods of the first and second sensing windings with respect to a direction of motion of the carriage along the pathway.

41. The system of claim 38 or 39 wherein the first and second sensing windings have periods that are integer multiples of a period of the transmitter winding with respect to a direction of motion of the carriage along the pathway.

42. A pathway system for determining position of a carriage traveling along a pathway, the system comprising a coil assembly including first and second sensing windings proximate to each other, each sensing winding having an identical spatial period and being repetitively disposed along the pathway, a transmitter winding extending along the pathway for generating a magnetic field along the pathway, and a transducer assembly coupled to the carriage, the transducer assembly comprising a resonant current loop positioned to induce position-indicating signals in the first and second sensing windings that vary with a position of the carriage along the pathway.

43. The pathway system of claim 42, wherein the resonant current loop generates a power signal for use with respect to the carriage.

44. The pathway system of claim 42, wherein a tuning of the resonant current loop is varied, modulating the position-indicating signals induced in the first and second sensing windings.

45. The pathway system according to claim 44, wherein the further signal identifies the carriage.

46. The pathway system of claim 42, wherein the resonant current loop is lithographically formed on a circuit board.

47. A system for determining position of a carriage, vehicle or the like moving along a pathway, wherein the system comprises a coil assembly extending along and being securable against movement with respect to the pathway, wherein the coil assembly includes a current winding that constitutes a linear motor for operatively driving a carriage along the pathway a first and a second sensing winding being periodic and out of phase with respect to each other, the sensing windings disposed in stationary proximity to the current winding for electromagnetic signal coupling from the current winding to the sensing windings such that passage of a coupling element over the coil assembly varies the electromagnetic signal coupling so as to generate signals in the first and second windings that vary with position of the coupling element to indicate position along the pathway.

48. The pathway system of claim 47, further comprising a coupling element adapted for moving with a carriage along the sensing windings so that as the carriage moves signals coupled to the sensing windings indicate position of the carriage.

49. A system for determining position of a carriage or the like moving along a pathway, wherein the system comprises a coil assembly extending along and being securable against movement with respect to the pathway, wherein the coil assembly includes a current winding that constitutes a linear motor for operatively driving a carriage along the pathway first and second sensing windings proximate to each other, each sensing winding having an identical spatial period and being repetitively disposed along the pathway, a transducer assembly configured for mounting on the carriage to passively receive magnetic energy from the current winding in a resonant current loop, the loop being positioned to induce position-indicating signals in the first and second sensing windings as the carriage carries the transducer along the pathway, thereby passively providing an electrical signal indicative of position.

50. A method for determining position of a carriage, vehicle or the like moving along a pathway, such method comprising the steps of providing a coil assembly configured for extending along and being securable against movement with respect to the pathway wherein the step of providing the coil assembly includes providing a transmitter winding, a first sensing winding and a second sensing winding, the transmitter winding being disposed in stationary proximity to the transmitter winding for electromagnetic coupling of a signal therein to the first and to the second sensing windings, the first and second sensing windings being periodic and out of phase with respect to each other mounting a coupling assembly to a carriage positioned such that as the carriage moves along the pathway, the coupling assembly varies coupling from the transmitter winding to the first and second sensing windings so as to passively generate signals it the first and second windings that indicate position of the carriage along the pathway without requiring an active power source on the carriage.

51. A method for determining position of a carriage or the like moving along a pathway in a system having a current winding fixedly extending along the pathway that constitutes a linear motor for operatively driving the carriage along the pathway, such method comprising the steps of providing a first and a second sensing winding proximate to each other, each sensing winding having an identical spatial period and being repetitively disposed along the pathway operating the current winding to generate magnetic flux, and mounting a transducer on the carriage to passively receive the flux in a resonant current loop, the loop being positioned to induce phased position-indicating signals in the first and second sensing windings as the carriage carries the transducer along the pathway thereby passively providing an electrical signal indicative of carriage position.

* * * * *

UNITED STATES PATENT AND TRADEMARK OFFICE

CERTIFICATE OF CORRECTION

PATENT NO. : 6,781,524 B1
DATED : August 24, 2004
INVENTOR(S) : Tracy M. Clark and Brian M. Perreault It is certified that error appears in the above-identified patent and that said Letters Patent is hereby corrected as shown below:

Column 12,
Line 62, "deposed" should read -- disposed --

Signed and Sealed this

Twenty-second Day of March, 2005

JON W. DUDAS
*Director of the United States Patent and Trademark Office*